United States Patent [19]

Berecz

[11] Patent Number: 4,474,090

[45] Date of Patent: Oct. 2, 1984

[54] NUT INSTALLATION TOOL

[75] Inventor: Imre Berecz, El Toro, Calif.

[73] Assignee: Microdot Inc., Darien, Conn.

[21] Appl. No.: 374,614

[22] Filed: May 3, 1982

[51] Int. Cl.[3] ..... B25B 23/04

[52] U.S. Cl. ..... 81/431; 81/125

[58] Field of Search ..... 81/431, 125

[56] References Cited

U.S. PATENT DOCUMENTS 2,836,091 5/1958 Mann ..... 81/125

2,993,397 7/1961 Albertson et al. ..... 81/125

*Primary Examiner*—James L. Jones, Jr.

*Attorney, Agent, or Firm*—Lyman R. Lyon

[57] ABSTRACT

The disclosure relates to a nut installation tool comprising a magazine for storing a plurality of nuts, a rotatable drive spindle having an internal configuration complementary to the external configuration of the nuts so as to slidably accept said nuts yet effect rotation thereof upon rotation of said drive spindle, power driven means for effecting rotation of said drive spindle, and means that function as a stop for said nuts that effects controlled release thereof from said magazine for movement outwardly thereof into said drive spindle.

1 Claim, 4 Drawing Figures

NUT INSTALLATION TOOL

BACKGROUND OF THE INVENTION

Nut installation tools are often used in the aircraft industry to expedite the assembly of airframes. Such nut installation tools speed up the assembly operation as well as insure uniformity of the finished product by providing controlled application torque to the nut. Known installation tools generally comprise a magazine with means therein for feeding the nut to a driving head. The head can be driven by air, hydraulic or electric motive power depending upon the assembly operation in which the tool is utilized.

SUMMARY OF THE INVENTION

The invention relates to a nut installation tool comprising a magazine for storing a plurality of nuts. A rotatable drive spindle has an internal configuration complementary to the external configuration of the nuts so as to slidably accept the nuts yet effect rotation thereof upon rotation of the drive spindle. Power driven means effects rotation of the drive spindle. A nose element is disposed in axially telescoping relationship to the drive spindle and extends relative thereto to a first position so as to be solely engageable with a workpiece. Resilient means normally biases the nose element toward the first position. First and second axially spaced apertures in the drive spindle accept first and second nut retainer balls, respectively. First and second axially spaced ramped recesses in the nose element also accept said first and second balls, respectively. However, the axial spacing of the recesses in the nose element is different than the axial spacing of the apertures in the drive spindle whereby when the nose element is in its first position the first nut retainer ball is biased by the nose element radially inwardly into its complementary first aperture in the drive spindle to function as a stop for the nuts and the second nut retainer ball is free to move radially outwardly into its complementary second recess in the nose element thereby to release the nuts in the magazine for movement outwardly thereof into the drive spindle.

DETAILED DESCRIPTION OF THE PREFERRED EMBODIMENT OF THE INVENTION

Figure 1:
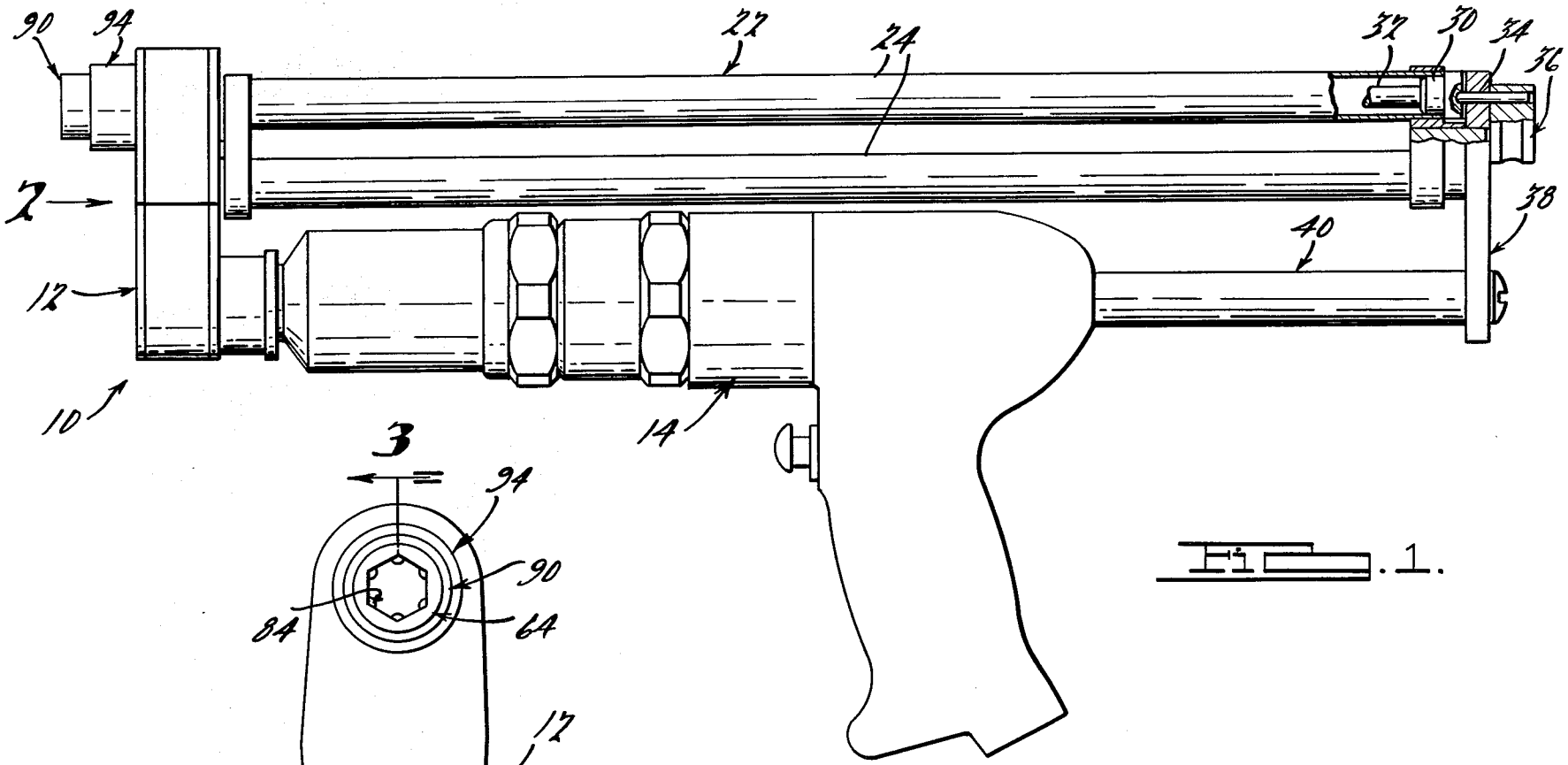
FIG. 1 is an elevational view of the tool of the instant invention.

Referring to FIG. 1, a nut installation tool 10 in accordance with the present invention comprises an improved driving head 12 that is driven by a conventional motor 14, for example, an air motor. Speed reduction is achieved by a spur gear train in the head 12. The driving head 12 affects positive control of nuts 20 being delivered from a multiple tube rotary magazine 22.

The rotary magazine 22, in a constructed embodiment, comprises five tubes 24 that are rotatable about a common central axis. Each of the tubes 24 is provided with an end plug 30 and a central nut spindle 32. The tubes 24 are indexed to a feed position by an indexing pin 34 which is mounted on a manually retractable control knob 36. The control knob 36 and feed tubes 24 are supported by a bracket 38 which, in turn, is supported by a rear extension 40 of the air motor 14.

Figure 3:
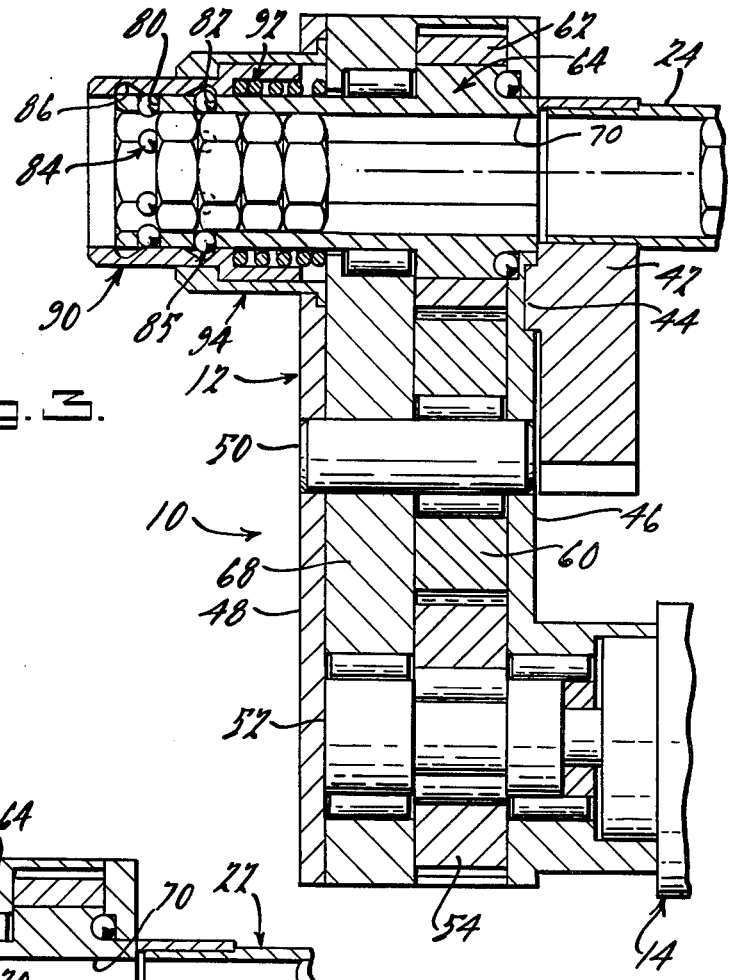
FIG. 3 is a cross-sectional view taken along the line 3—3 of FIG. 2.
Figure 4:
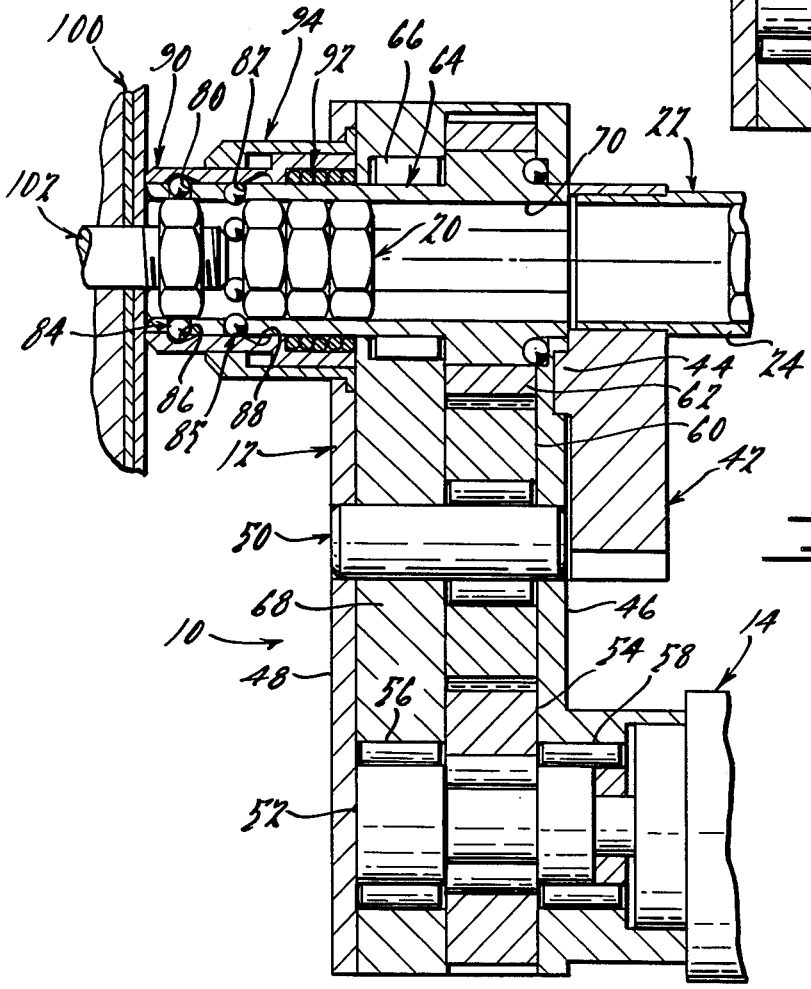
FIG. 4 is a cross-sectional view similar to FIG. 3 with the tool in engagement with a workpiece.

As best seen in FIGS. 3 and 4, the front end of each feed tube 24 is carried by a rotary element 42 that has a spindle 44 journaled in one wall 46 of the head 12.

An opposite wall 48 of the head 12 combines with the wall 44 to support an intermediate shaft 50 and a drive shaft 52. The drive shaft 52 is connected to the output end of the motor 14, by conventional means, and supports a spur gear 54. The drive shaft 52 is journaled in suitable roller bearings 56 and 58 to insure positive alignment, minimize friction, and insure operational longevity. The spur gear 54 on the drive shaft 52 is meshed with an idler gear 60 on the intermediate shaft 50. The idler spur gear 60 meshes with a spindle gear 62 that is carried by a hollow rotatable drive spindle 64. The drive spindle 64 is journaled in a needle bearing 66 that is supported by an inner element 68 of the head 12.

Figure 2:
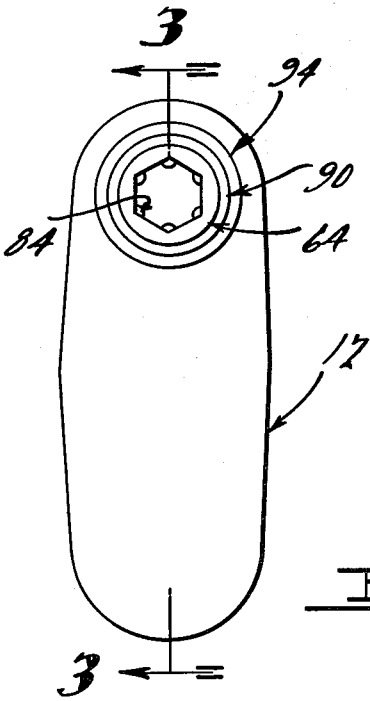
FIG. 2 is a view taken in the direction of the arrow 2 of FIG. 1.

The open end of a feed tube 24 registers with a complementary central aperture 70 in the drive spindle 64. It is to be noted that the aperture 70 in the spindle 64, as best seen in FIG. 2, is of hexagonal cross section to permit slidable registry of the nuts 20 therein yet effect driving of the nuts 20 about the central axis of the spindle 64.

In accordance with one feature of the instant invention, the drive spindle 64 is provided with two axially spaced sets of apertures 80 and 82 in a hexagonal array at the corners of the hexagonal configuration thereof. The apertures 80 and 82 accept a like plurality of balls 84 and 85. The balls 84 and 85 are slightly larger than the radial thickness of the drive spindle 64 and are free to move radially of the drive spindle 64 under the control of a pair of annular ramped cavities 86 and 88 in a nose element 90. The nose element 90 is slidably journaled on the drive spindle 64 and is normally biased to the left, as seen in FIGS. 3 and 4, by a helical compression spring 92. Outward movement of the nose element 90 is limited by an outer sleeve 94.

As best seen by comparing FIGS. 3 and 4, movement of the nose element 90 due to engagement with a workpiece 100 affects both release of a nut 20 for drivable acceptance on a complementary threaded element 102 and retention of the nuts 20 disposed rearwardly thereof in the drive spindle 64 and delivery tube 24. Controlled feed of the nuts 20 is initiated by radially outward movement of the forward set of balls 84 in their complementary apertures 80 in the drive spindle to the position shown in FIG. 4. In this position, the balls 84 permit forward movement of the forwardmost nut 20 onto the threaded element 102. Concomitantly, the rearward set of balls 85 is biased radially inwardly due to the slope of the ramps 88 and are held in this position by the inner wall of the nose element 90 thereby to function as a stop for the nuts 20 rearwardly of the forwardmost nut 20. The aforesaid nut driving and nut retaining action is achieved by the differential in axial spacing between the apertures 80 and 82 and the ramps 86 and 88.

After the nut 20 is driven onto the complementary stud 102, the installation tool 10 is retracted from the workpiece allowing the nose element 90 to be driven axially outwardly of the head 12 under the bias of the helical compression spring 92. Outward movement of the nose element 90 drives the balls 84 radially inwardly due to the slope of the ramp portion of the annular recess 86 in the nose element 90. In this condition, the forwardmost balls 84 now function as a stop for all of the nuts 20 in the feed tube 24. It is to be noted that when the nose element 90 is biased outwardly to cam the forwardmost balls 84 to their radially inward position, the rearward balls 85 are allowed to move radially outwardly into their complementary annular recess 88 permitting the next nut 20 stored in the spindle 64 to move to the feed position.

From the foregoing description it should be apparent that the nut installation tool of the instant invention features a relatively simple yet positive delivery head for controlling feed of nuts to a delivery station and subsequent delivery of said nuts onto a complementary threaded workpiece. The tool is relatively compact and utilizes a minimum of structural elements.

While the preferred embodiment of the invention has been disclosed, it should be appreciated that the invention is susceptible of modification without departing from the scope of the following claims.

I claim:

1. A nut installation tool comprising a magazine for storing a plurality of nuts, a rotatable drive spindle having an internal configuration complementary to the external configuration of the nuts so as to slidably accept said nuts yet effect rotation thereof upon rotation of said drive spindle, power driven means for effecting rotation of said drive spindle, a nose element disposed in axially telescoping relationship over said drive spindle, said nose element extending to a first position axially outwardly relative to said drive spindle so as to be solely engageable with a workpiece upon advancement of said tool toward said workpiece, resilient means normally biasing said nose element outwardly of said drive spindle toward said first position, an axially outer and an axially inner aperture in said drive spindle, axially outer and axially inner nut retainer balls in said apertures, respectively, axially outer and axially inner recesses in said nose element for the acceptance of said axially outer and axially inner balls, respectively, the axial spacing of the recesses in said nose element being greater than the axial spacing of the apertures in said drive spindle, the axially inner recess in said nose element being radially aligned with the axially inner aperture in said drive spindle and the axially outer recess in said nose element being out of radial alignment with the axially outer aperture in said drive spindle when said nose element is in said first position whereby the axially outer nut retainer ball is biased by said nose element radially inwardly through its complementary axially outer aperture in said drive spindle to function as a stop internally thereof for said nuts and said axially inner nut retainer ball is free to move radially outwardly into its complementary axially inner recess in said nose element thereby to release the nuts in said magazine for movement outwardly thereof into said drive spindle, retraction of said nose element over said drive spindle due to engagement with a workpiece bringing the axially outer recess in said nose element into radial alignment with the axially outer aperture in said drive spindle to permit radially outward movement of the axially outer ball into the axially outer recess in said nose element and movement of a nut axially outwardly of said drive spindle, retraction of said nose element over said drive spindle also moving the axially inner recess therein out of radial alignment with the axially inner aperture in said drive spindle thereby to drive said axially inner ball radially inwardly to function as an inner stop for said nuts.

* * * * *